United States Patent [19]

Kobayashi et al.

[11] Patent Number: 4,958,950

[45] Date of Patent: Sep. 25, 1990

[54] PAPER FEEDER FOR PRINTER

[75] Inventors: Yousuke Kobayashi; Keiichi Fukazawa, both of Hiroshima, Japan

[73] Assignee: Mitsubishi Denki Kabushiki Kaisha, Japan

[21] Appl. No.: 330,690

[22] Filed: Mar. 30, 1989

[30] Foreign Application Priority Data

Apr. 21, 1988 [JP] Japan ..... 63-100491

[51] Int. Cl.[5] ..... B41J 13/03

[52] U.S. Cl. ..... 400/629; 400/628; 400/624; 400/649

[58] Field of Search ..... 400/628, 629, 649, 624; 271/160, 114, 257, 267

[56] References Cited

U.S. PATENT DOCUMENTS

| | | | |
|---|---|---|---|
| 4,113,245 | 9/1978 | Colglazier et al. | 271/10 |
| 4,416,559 | 11/1983 | Steinhilber | 400/629 |
| 4,729,683 | 3/1988 | Staniszewski | 400/624 |
| 4,830,353 | 5/1989 | Hendriks et al. | 271/160 |

FOREIGN PATENT DOCUMENTS

| | | |
|---|---|---|
| 0104337 | 4/1974 | European Pat. Off. . |
| 0128867 | 12/1984 | European Pat. Off. . |
| 0139426 | 5/1985 | European Pat. Off. . |
| 58-211479 | 12/1983 | Japan . |
| 62-59625 | 4/1987 | Japan . |

OTHER PUBLICATIONS

IBM Technical Disclosure Bulletin, vol. 30, No. 5, Oct. 1987.

"Sheet Separator and Feeder", Xerox Disclosure Journal, vol. 8, No. 6, Nov./Dec. 1983.

*Primary Examiner*—Edgar S. Burr
*Assistant Examiner*—Ren Yan
*Attorney, Agent, or Firm*—Leydig, Voit & Mayer

[57] ABSTRACT

A paper feeder comprises a tray having a stage on which papers to be fed are stacked, driving means for driving a platen, transmitting means for transmitting a motive power of the driving means to position the stage at predetermined position for paper feeding operation, and paper feeding means having a roller for feeding the uppermost one of the papers stacked on the stage when the uppermost paper positioned to contact with the feeding roller at the predetermined position by the motive power. It is advantageous that the paper feeder can be made economical and compact since there is no need to provide an exclusive motive power source having a speed reducer. Furthermore, a contact pressure between the paper feeding roller and the paper is stabilized to enhance the accuracy of the paper feeding.

5 Claims, 2 Drawing Sheets

PAPER FEEDER FOR PRINTER

BACKGROUND OF THE INVENTION

The present invention relates to a paper feeder for a printer, particularly to a paper feeder in which a stage of a paper tray on which sheets of paper are stacked up is moved toward a paper feeding means such as paper feeding rollers to feed the sheets of paper one by one to the printer.

FIG. 1 is a schematic diagram illustrating a side view of a conventional paper feeder for a printer, which was disclosed in the Published Unexamined Japanese Utility Model Application No. 59625/1987. Shown in FIG. 1 are a paper tray 1, a stage plate 2 of the paper tray 1, on which sheets of papers 4 are stacked up, the stage 2 being swingable about one end thereof as a fulcrum 3, a mounting portion 5 on which the paper tray 1 is mounted, a motor 6, an arm wheel 7 coupled to the motor 6, a paper feeding roller 8, a pair of paper conveyance rollers 9*a* and 9*b*, a pair of paper guides 10*a* and 10*b*, an actuator 11, and a photocoupler sensor 12 which act as means for detecting the height of the paper stacked up on the stage 2. The other free end of the stage 2 is urged upwardly by the tip 7*a* of the arm wheel 7 as indicated by an arrow in FIG. 1. When the uppermost one of the sheets of paper 4 on the stage 2 has then reached such a height as to come into contact with the paper feeding roller 8, the actuator 11 causes the photocoupler sensor 12 to stop the rotation of the arm wheel 7. Then, the paper feeding roller 8 rotates to feed the uppermost paper 4 so that the paper is conveyed along the paper guides 10*a* and 10*b* by the conveying rollers 9*a* and 9*b*.

The above described conventional paper feeder is disadvantageous in that the contact pressure between the paper feeding roller 8 and the paper 4 changes greatly due to the difference in the position of the paper detected by the photocoupler 12, as a result of which the sheets of paper cannot be fed to the printer stably. Further, since the contact pressure is about 200g, relatively high rotation torque is required to the arm wheel 7. This results in another drawback that it is necessary to employ an expensive motor having a speed reducer or the like as the motor 6 resulting in increasing the manufacturing cost of the paper feeder.

SUMMARY OF THE INVENTION

The present invention is made in order to solve the problems. Accordingly, it is an object of the present invention to provide a paper feeder which can feed sheets of paper one by one to a printer stably without using an exclusive motive power source to put the sheets of paper into pressure contact with a paper feeding roller.

The above, and other objects of the present invention are accomplished by the provision of a paper feeder in which a step motor which drives a platen is used as a motive power source to urge a stage upwardly, and the driving force of the motive power source is amplified by a linkage to exert contact pressure on the sheets of paper and the paper feeding roller.

DESCRIPTION OF THE PREFERRED EMBODIMENT

Figure 1:
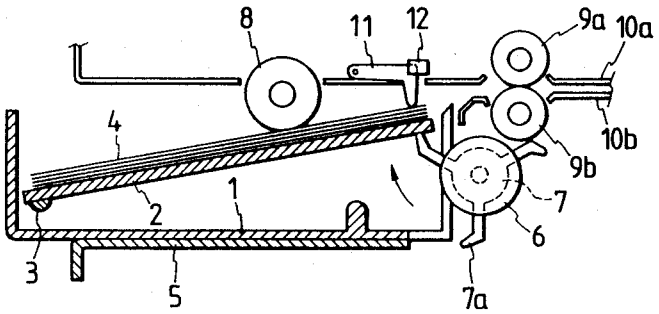
FIG. 1 PRIOR ART
FIG. 1 is a schematic diagram showing a side view of a conventional paper feeder.
Figure 2:
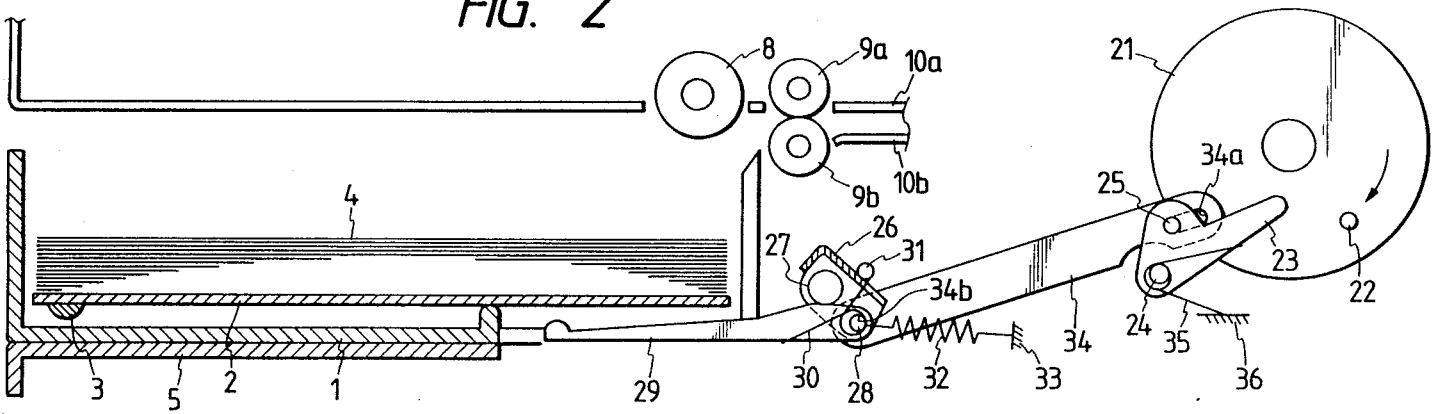
FIGS. 2 and 3 are schematic diagrams showing an embodiment of a paper feeder according to the present invention.

An embodiment of the present invention will be described with reference to FIGS. 2 and 3 which show a side view of a paper feeder. In FIG. 2, a platen 21 is driven by a step motor in a rotation direction indicated by an arrow. A pin 22 is secured to an end face of the platen 21. A lever 23 is rotatably supported at a fulcrum 24. A pin 25 is secured to the lever 23. An angle 26 is rotatably supported at a fulcrum 27. A shaft 28 is secured to the angle 26. A paper feeding lever 29 is swingable about the shaft 28. A torsion spring 30 is engaged at one end thereof with the paper feeding lever 29 and at the other end thereof with the angle 26 to urge the paper feeding lever 29 toward the fulcrum 27. A tension spring 32 engages at one end thereof with the shaft 28 and at the other end thereof with a fixed end 33 to put the angle 26 in contact with a stopper 31 so as to keep the paper feeding lever 29 in a prescribed position. A link 34 has a slender hole 34*a* at one end thereof and a circular hole 34*b* at the other end thereof. The pin 25 is fitted in the slender hole 34*a* whereas the shaft 28 is fitted in the circular hole 34*b* to pivotally couple the link 34. A torsion spring 35 is engaged at one end thereof with a fixed end 36 and at the other end thereof with the lever 23 to keep the lever 23 in a prescribed position with a very weak force under the condition that the pin 25 is in contact with the hole 34*a* of the link 34. The remaining portions of the paper feeder which are same as or correspond to those of the above-mentioned conventional paper feeder, bear the same reference numeral.

Figure 3:
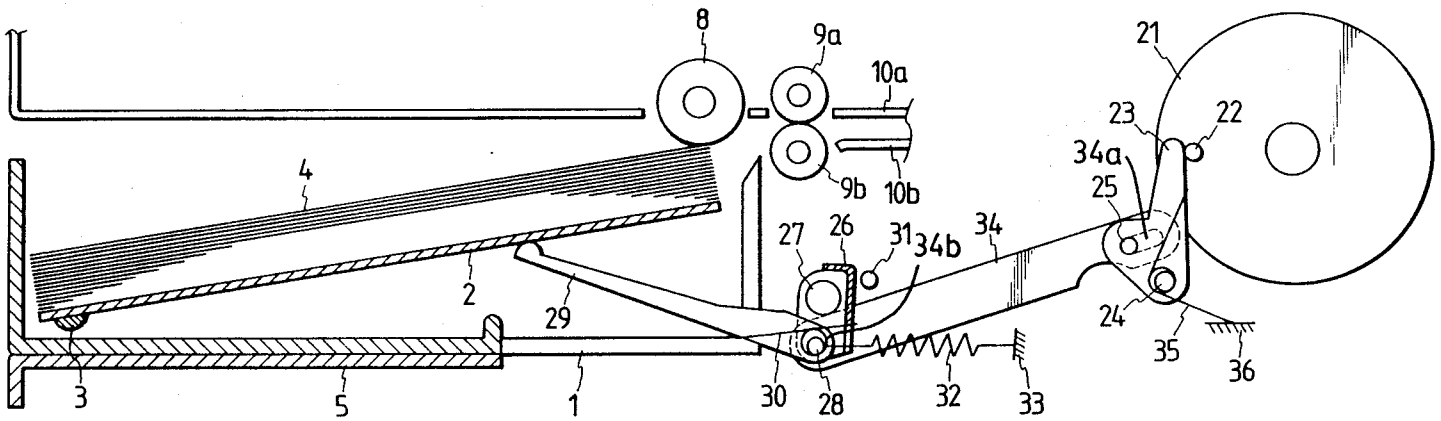

The operation of the paper feeder shown in FIGS. 2 and 3 will be now described. When the platen 21 is rotated clockwise as indicated by an arrow in FIG. 2, the pin 22 secured to the platen 21 causes the lever 23 to turn about the fulcrum 24 in a counter-clockwise direction as shown in FIG. 3 and then the movement of the link 34 causes the angle 26 to turn around the fulcrum 27 to thereby cause the lever 29 to turn around the shaft 28. As a result, the stage 2 is urged upwardly by the tip of the paper feed lever 29 so that the uppermost one of the sheets of paper 4 stacked on the stage 2 comes into contact with the paper feeding roller 8, the paper feeding lever 29 starts separating from the fulcrum 27, and the torsion spring 30 exerts contact pressure on the paper feeding roller and the uppermost sheet of paper. In this case, it should be noted that the spring modulus of the torsion spring 30 is preset so that the contact pressure remains nearly unchanged, regardless of the amount of the sheets of paper 4 stacked on the stage 2. When the pin 22 is revolved to position on a horizontal plane containing the center of the platen 21, as shown in FIG. 3, a step motor which drives the platen 21 is stopped and the uppermost sheet of paper 4 is fed by the paper feeding roller 8 and then conveyed to the paper guides 10*a* and 10*b* by the feeding rollers 9*a* and 9*b*. As soon as the paper 4 has reached the platen 21, the platen 21 is rotated counterclockwise so that the paper feeder is put out of the paper feed state due to the reverse movement of the lever 23, the link 34 and the paper feeding lever 29.

Since the platen 21 is always rotated counterclockwise except to put the paper feeder into the paper feeding state, the link 34 is provided with the slender hole 34*a* at one end of the link in order to put the link away from the locus of the pin 22 when the pin comes into contact with the lever 23.

According to the present invention, a stage is urged upwardly by a step motor for driving a platen, so that the cost of a paper feeder is reduced and the feeder is made compact. Besides, the contact pressure between a paper feed roller and sheets of paper in stabilized to enhance the accuracy of the feed of the sheets of paper. Since motive power for urging the stage upwardly is transmitted by a linkage, the urging stroke of the stage and the contact pressure can be preset by changing the length of the link of the linkage optionally.

What is claimed is:

1. A paper feeder for a printer comprising:

a tray having a stage on which papers to be fed are stacked, the stage being movable between predetermined first and second positions;

a platen rotatable in a first direction and in a reverse direction;

a motor connected to rotate said platen by producing motive power;

means for transmitting the motive power of said motor to position said stage at the predetermined first position for paper feeding operation when said platen rotates in the reverse direction; and a paper feeding means having a feeding roller for feeding an uppermost one of said papers during the feeding operation, the predetermined first position of said stage bringing the uppermost paper into contact with said feeding roller;

wherein said transmitting means comprises:

a first pin connected to said platen;

a first fulcrum;

a lever rotatably supported at said first fulcrum and urged by said first pin, the lever having a second pin mounted thereon;

a second fulcrum;

an angle member having first and second ends rotatably supported at the first end by said second fulcrum;

a shaft connected to the second end of said angle member;

a link having first and second ends engaged at the first end thereof with said lever by said second pin and at the second end thereof with said angle member;

a paper feeding lever rotatable about said shaft in accordance with the rotation of said platen in the reverse direction to urge said stage to the predetermined first position; and a first torsion spring engaged at one end thereof with said paper feeding lever and at the other end thereof with said angle member to urge said paper feeding lever.

2. A paper feeder as claimed in claim 1, wherein said link has a slender hole at the first end thereof in order to put said link away from the locus of said first pin when said driving means drives said platen to rotate in the first direction.

3. A paper feeder as claimed in claim 2 wherein said link further comprises:

first and second fixed ends;

a stopper;

a tension spring engaged at one end thereof with said shaft and at the other end thereof with said first fixed end to put said angle member in contact with said stopper so that said paper feed lever is kept in a predetermined second position; and a second torsion spring engaged at one end thereof with said second fixed end and at the other end thereof with said lever to put said second pin in contact with said link so that said lever is kept in a predetermined third position by a small force.

4. A paper feeder as claimed in claim 1, wherein said motor stops rotating said platen in reverse direction when said first pin is positioned on a horizontal plane so that the uppermost paper is fed by said paper feeding means, and then said motor drives said platen in the first direction for the reverse movement of said transmitting means.

5. A paper feeder as claimed in claim 4 wherein said horizontal plane contains the center of said platen.

* * * * *